US008393860B2

(12) United States Patent
Czechowski et al.

(10) Patent No.: US 8,393,860 B2
(45) Date of Patent: Mar. 12, 2013

(54) HEAT EXCHANGER

(75) Inventors: Edward S. Czechowski, Orchard Park, NY (US); Andrew Newman, Buffalo, NY (US); Scott Tackett, Houston, TX (US)

(73) Assignee: Cameron International Corporation, Houston, TX (US)

( * ) Notice: Subject to any disclaimer, the term of this patent is extended or adjusted under 35 U.S.C. 154(b) by 1357 days.

(21) Appl. No.: 11/956,139

(22) Filed: Dec. 13, 2007

(65) Prior Publication Data

US 2009/0155096 A1 Jun. 18, 2009

(51) Int. Cl.
*F04D 29/58* (2006.01)

(52) U.S. Cl. ..... 415/176; 415/178; 417/373; 165/163; 165/176

(58) Field of Classification Search ..... 415/175–180; 417/372, 373; 165/163, 176
See application file for complete search history.

(56) References Cited

U.S. PATENT DOCUMENTS

| | | | | |
|---|---|---|---|---|
| 3,355,097 | A * | 11/1967 | Hornschuch | 415/177 |
| 3,662,817 | A * | 5/1972 | Kendrick et al. | 165/175 |
| 4,010,016 | A * | 3/1977 | Haugen | 415/179 |
| 4,125,345 | A | 11/1978 | Yoshinaga et al. | |
| 4,800,955 | A * | 1/1989 | Hagemeister et al. | 165/163 |
| 6,929,056 | B2 * | 8/2005 | Meshenky et al. | 415/176 |
| 6,948,909 | B2 | 9/2005 | Meshenky et al. | |

FOREIGN PATENT DOCUMENTS

| | | |
|---|---|---|
| CH | 638019 | 8/1983 |
| DE | 2541715 | 4/1976 |
| DE | 3738425 | 6/2010 |
| EP | 0036213 | 9/1981 |
| GB | 1022352 | 3/1966 |
| WO | WO2007079137 | 7/2007 |

* cited by examiner

*Primary Examiner* — Christopher Verdier
(74) *Attorney, Agent, or Firm* — Fletcher Yoder PC

(57) ABSTRACT

Systems, methods, and devices are disclosed, including a heat exchanger having a manifold with a coolant inlet and a coolant outlet and a plurality of tubes with interiors fluidly connected to the manifold. In some embodiments, the plurality of tubes and the manifold are configured to fit within a bonnet of a compressor.

13 Claims, 6 Drawing Sheets

HEAT EXCHANGER

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Compressors often employ a heat exchanger to lower the temperature of a compressed fluid. As the fluid is compressed, the temperature of the fluid typically rises. The temperature increase, however, is often undesirable because it reduces the effectiveness of the compressor. Thus, to reduce the temperature, the compressed fluid is often directed through a heat exchanger.

Certain types of heat exchangers are expensive to maintain because of corrosion. In particular, buildup from corrosion is known to affect liquid-cooled heat exchangers. These devices remove heat from a higher temperature fluid by passing high temperature fluid over a conduit carrying a lower temperature liquid. The liquid coolant, however, can corrode the conduit, thereby impeding the coolant's flow. For example, some water-cooled heat exchangers rust and deteriorate over time. Particularly susceptible to this corrosion are water-in-shell designs, in which the hot compressed fluid flows through tubes that are immersed in water. The surrounding water is typically disposed in a shell, thereby potentially exposing the shell and exterior of the tubes to corrosion. This corrosion can precipitate expensive maintenance procedures: in some instances, the corroded part is replaced, re-machined, or cleaned chemically. Each of these procedures results in a period of time in which the compressor is not functioning and adds to the cost of maintaining the compressor.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
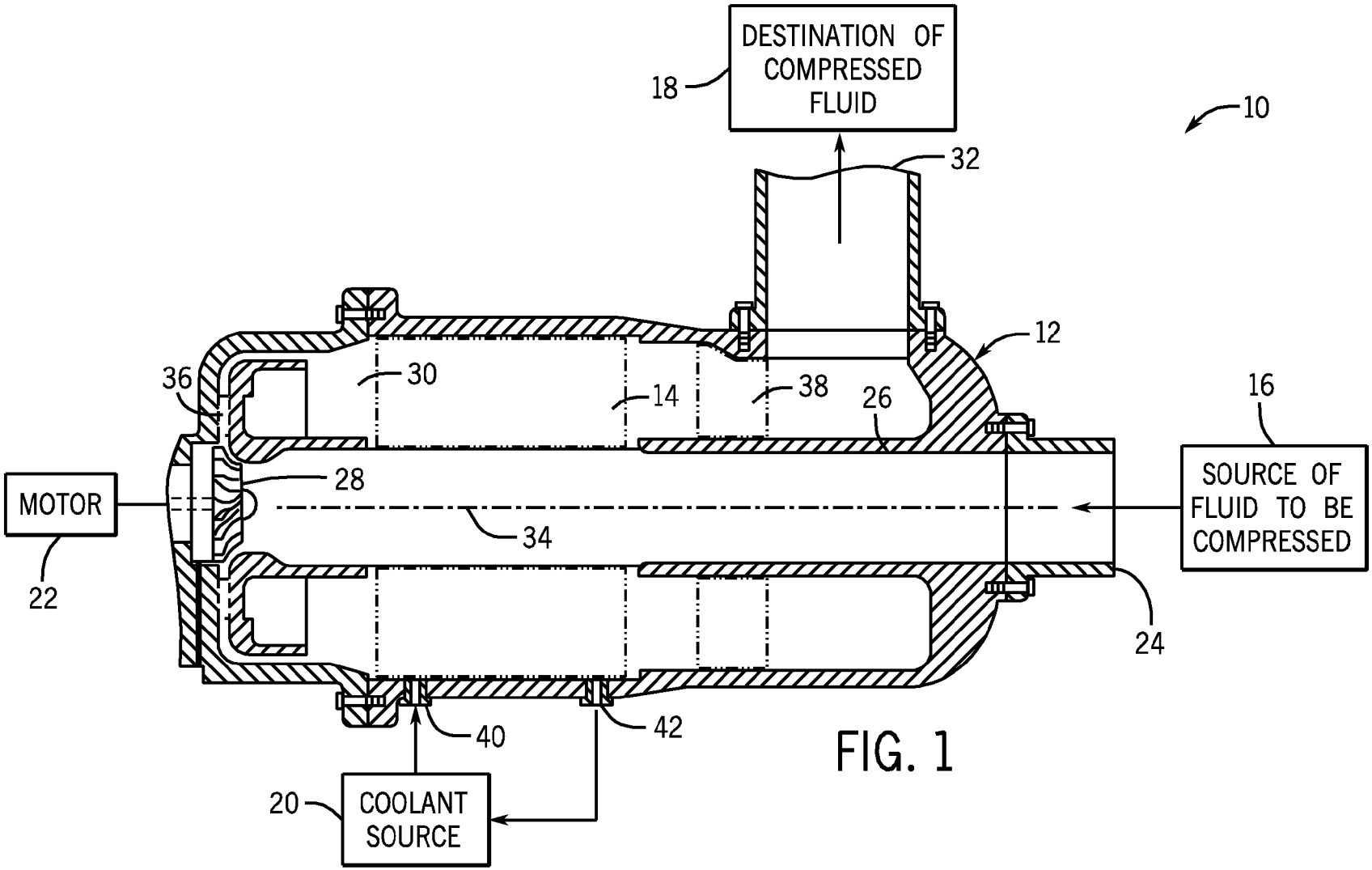
FIG. 1 is a cross-section of an example of a fluid-handling system.

FIG. 1 illustrates an example of a fluid-handling system 10. The illustrated system 10 includes a compressor 12 having a heat exchanger 14 that, in some embodiments, may alleviate some of the problems described above. The heat exchanger 14 is described below, after describing the other features of the fluid-handling system 10. The system 10 may also include a source of fluid to be compressed 16, a destination of compressed fluid 18, a coolant source 20, and a motor 22. In some embodiments, the compressor may be a compressor manufactured by Ingersoll Rand of Davidson, N.C. (or some other domestic or international facility), compressors such as, but not limited to, the CENTAC II family of compressors (e.g., the 1ACII, the 2CC, the 2ACII, the 2CII, the 3CII, and the 5CII) or the CENTAC CV family of compressors (e.g., the CV0, the CV1, the CV1A, and the CV2).

In this embodiment, in addition to the heat exchanger 14, the compressor 12 includes an inlet 24, an upstream chamber 26, an impeller 28, a downstream chamber 30, and an outlet 32. The illustrated inlet 24, upstream chamber 26, impeller 28, downstream chamber 30, and heat exchanger 14 are generally rotationally symmetric about a central axis 34 of the compressor 12. The upstream chamber 26, in this embodiment, defines a generally right-circular cylindrical volume that is generally concentric about the central axis 34, and the downstream chamber 30 defines a generally annular volume that is generally concentric about the central axis 34 and is disposed at least partially about the upstream chamber 26. The illustrated impeller 28 includes a plurality of blades and is disposed in series between the upstream chamber 26 and the downstream chamber 30. The impeller 28 is configured to rotate about the central axis 34 to compress a fluid flowing between the upstream chamber 26 and the downstream chamber 30, as explained below. The downstream chamber 30 may include a diffuser 36 configured to convert the kinetic energy of a fluid leaving the impeller 28 to pressure energy. The downstream chamber 30 also may include a stainless-steel moisture separator 38 configured to remove condensation from the compressed fluid after the heat exchanger. These components 36 and 38 may also be generally rotationally symmetric and generally concentric about the central axis 34.

The source 16 may be any of a variety of fluid sources. For example, the source 16 may be the atmosphere, a pressure vessel, a reaction vessel, a pipeline, or an outlet of another compressor. The fluid may be any of a variety of types of fluids, including air and other process gasses, e.g., nitrogen or methane. In some embodiments, the fluid may be characterized as factory air or process air for driving one or more machines or processes in a manufacturing line, e.g., a manufacturing line for making textiles, food, beverages, automobiles, pharmaceuticals, chemicals, electronics, aerospace equipment, industrial gases, petroleum products. Additionally, the fluid may be used for water treatment, snow making, or power generation. Accordingly, the destination 18 may be a pressure vessel, a reaction vessel, a pipeline, pneumatic devices, or an inlet of another compressor.

In this embodiment, the coolant source 20 connects to the heat exchanger 14 via a coolant inlet 40 and a coolant outlet 42. The coolant source 20 is configured to supply a cooling fluid, such as a liquid, to the heat exchanger 14. In some embodiments, the coolant source 20 supplies water, methanol, ethylene glycol, propylene glycol, combinations thereof, or other coolants. The temperature of the coolant entering the coolant inlet 40 may be substantially below the temperature of the compressed fluid entering the heat exchanger 14.

The illustrated impeller 28 includes a geared pinion connected indirectly to a motor 22. The motor 22 may include a variety of devices configured to deliver rotational kinetic energy. For example, the motor 22 may be an electric motor, steam turbine, gas turbine, or a combustion engine. In this embodiment, the motor 22 is connected to a bullgear (not shown), which in turn drives a geared pinion that holds the impeller 28. In some embodiments, the motor 22 may be configured to deliver between 400 hp and 5000 hp, for example, the illustrated motor is configured to deliver approximately 700 hp.

In operation, the compressor 12 receives a fluid from the source 16, compresses the fluid, removes heat from the fluid, removes moisture from the fluid, and then delivers the fluid to the destination 18. To begin this sequence, the fluid flows in through the inlet 24, and along the upstream chamber 26 to the impeller 28. The fluid hits the rotating blades of the impeller 28 and is driven radially outward from the central axis 34, toward the diffuser 36. The fluid is then slowed and compressed against the diffuser 36. After leaving the diffuser 36, the fluid turns 90 degrees in the downstream chamber 30, thereby reversing the direction of fluid flow relative to the fluid flow through the upstream chamber 26. The compressed fluid flows into the heat exchanger 14, and the heat exchanger 14 removes heat energy from the compressed fluid by exchanging heat between the compressed fluid and coolant from the coolant source 20, as described below with reference to FIGS. 2-4. Next, the compressed, cooled fluid flows through the moisture separator 38, which removes condensation that may have formed as the fluid was cooled. After leaving the moisture separator 38, the compressed fluid flows out through the outlet 32 to the destination 18.

Figure 2:
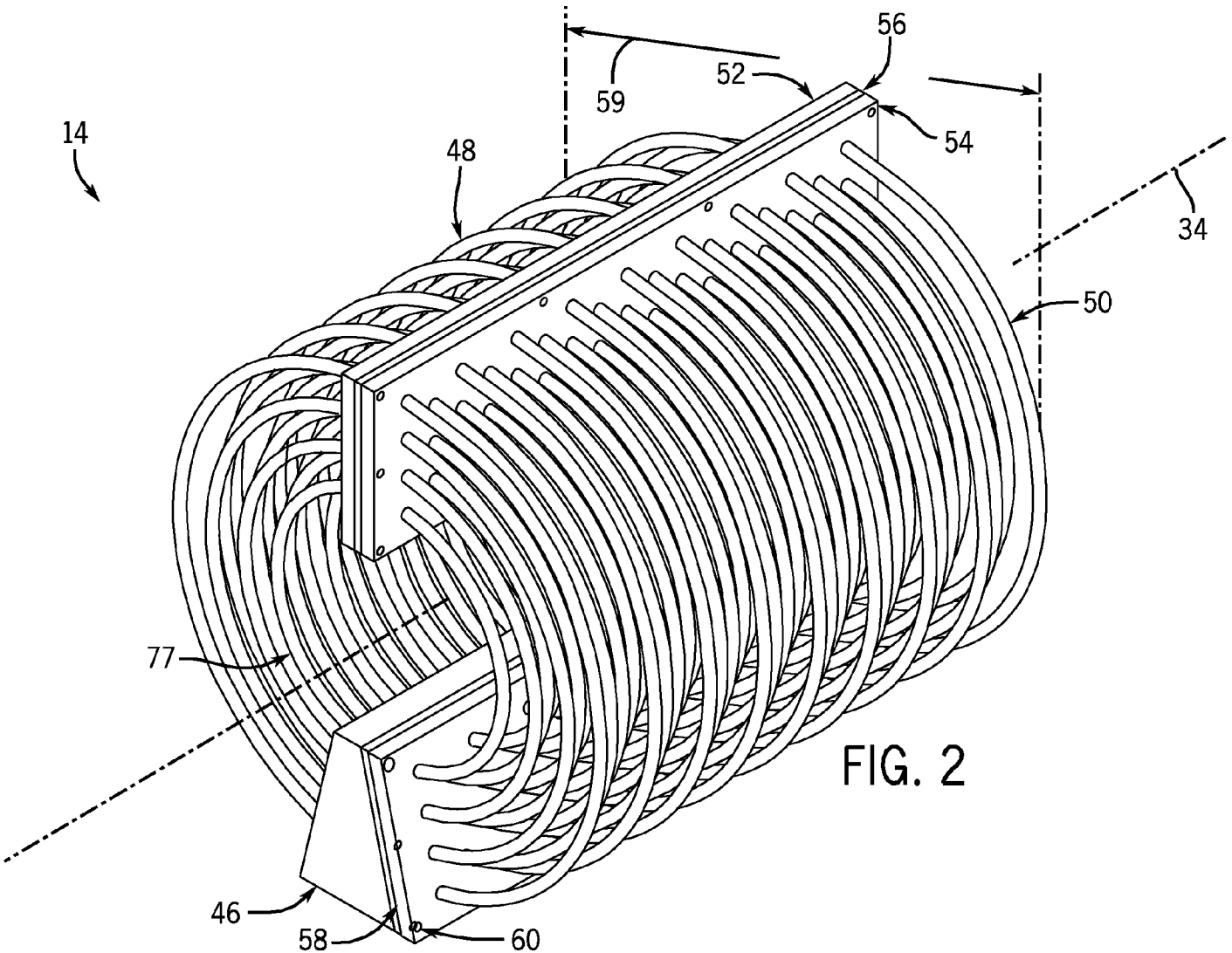
FIG. 2 is a perspective view of an example of a heat exchanger.
Figure 3:
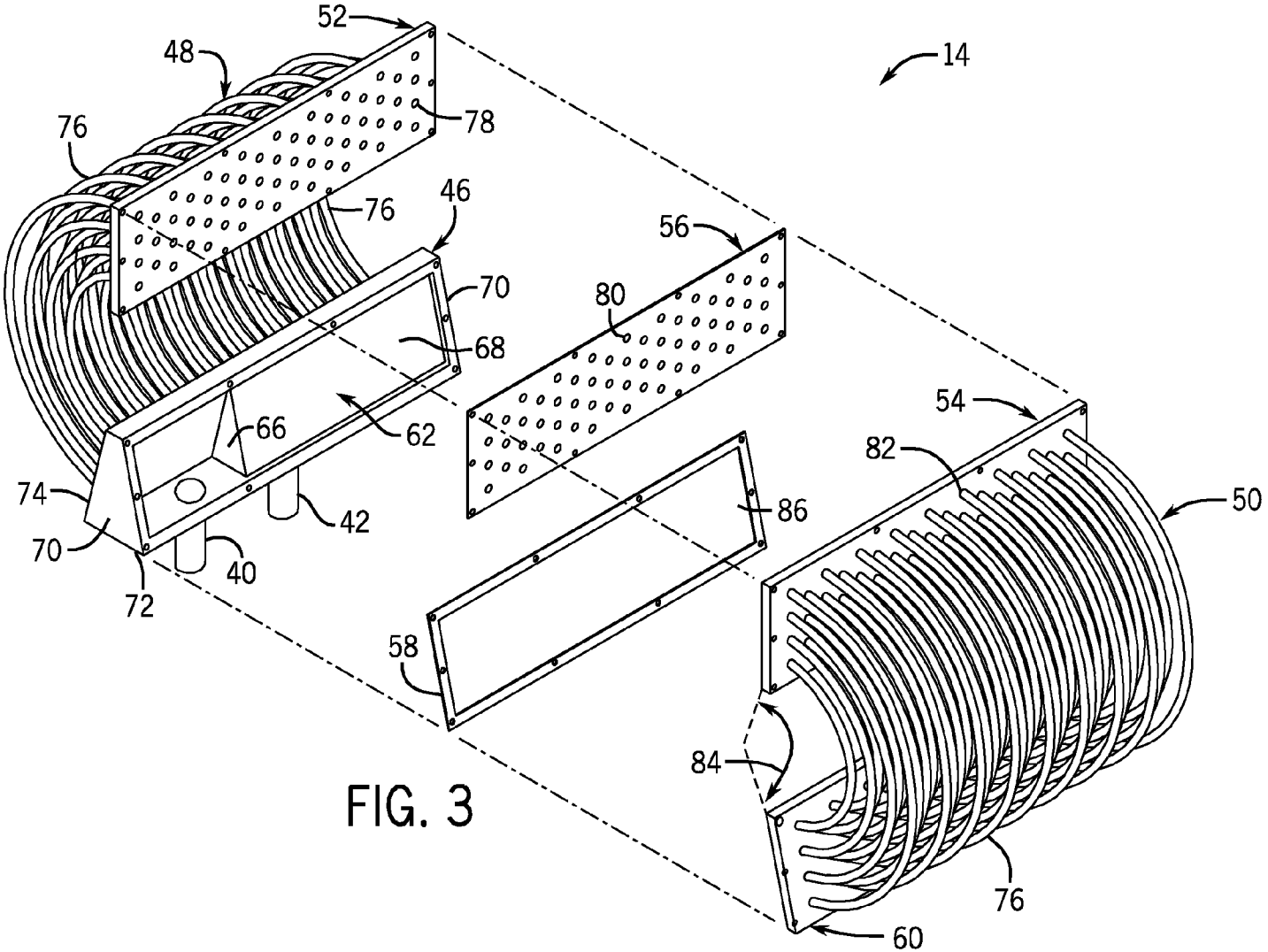
FIG. 3 is an exploded view of the heat exchanger of FIG. 2.

FIGS. 2 and 3 illustrate details of the heat exchanger 14. FIG. 2 illustrates the heat exchanger 14 assembled, and FIG. 3 illustrates a partially exploded view of the heat exchanger 14. In this embodiment, the heat exchanger 14 includes a manifold 46, tube sets 48 and 50, headers 52 and 54, gaskets 56 and 58, and a manifold cover 60.

As depicted by FIG. 3, the illustrated manifold 46 includes the coolant inlet 40, the coolant outlet 42, and a baffle 62. In this embodiment, the baffle 62 is a member that divides the interior of manifold into an upstream volume 66 and a downstream volume 68. The upstream volume 66 is in direct fluid communication with the coolant inlet 40, and the downstream volume 68 is in direct fluid communication with the coolant outlet 42. The illustrated manifold 46 defines a generally right prism volume with generally trapezoidal ends 70 and a base 72 that is generally curved. One wall 74 of the manifold 46 includes a plurality of holes that place the downstream volume 68 in fluid communication with the tube set 48. In this embodiment, the manifold 46 includes seals between the coolant inlet 40, the coolant outlet 42, and the body of the manifold 46. The manifold 46 may be made from aluminum, stainless steel, or other appropriate materials.

In this embodiment, the tube sets 48 and 50 include a plurality of tubes 76. The illustrated tubes 76 extend along a generally semicircular arc and curve at varying radii (e.g., each tube has a longitudinal axis that is generally curved along a substantial portion of its length). Each of the tubes 76 in the tube sets 48 and 50 may curve around the central axis 34, so that the assembled heat exchanger 14 is generally concentric about the central axis 34. The curvature of the tube sets 48 and 50 defines a central passage 77 of the heat exchanger 14. The tube sets 48 and 50 curve in opposite directions, forming generally opposing C-shapes, and are generally symmetric. The tubes 76 may be made of copper, aluminum, or other appropriate materials, and they may include a plurality of fins along their length, as explained below with reference to FIG. 4. The interior of the tube set 48 is in direct fluid communication with the downstream volume 68 of the manifold 46, and the interior of the tube set 50 is in direct fluid communication with the upstream volume 66 of the manifold 46. That is, the tube sets 48 and 50 connect to opposite sides of the baffle 62.

The tube sets 48 and 50 are joined by the headers 52 and 54 and the gasket 56. Each of these components 52, 56, and 54 has holes 78, 80, and 82 that are generally aligned with each other and the tube sets 48 and 50. In some embodiments, the holes 78, 80, and 82 may be generally arranged in a hexagonal lattice, with offset rows, or they may be arranged in a square lattice, with each of the rows and columns generally aligned. The headers 52 and 54 and the gasket 56 are, in this embodiment, generally flat and define generally cuboid volumes. The headers 52 and 54 may be made from machined or stamped stainless steel, aluminum, or other appropriate materials, and the gasket 56 may be made from metal, silicone, polymer, neoprene, or other appropriate materials.

The manifold cover 60 is generally similar to the header 54, except that it couples to the other end of the tube set 50. Thus, in this embodiment, the manifold cover 60 includes a plurality of holes that generally align with the tubes 76 in the tube set 50. The manifold cover 60 forms an angle 84 with the header 54 that may range from 165 to 188 degrees.

The gasket 58 is generally flat and generally sized to complement the sides of the manifold 46. In this embodiment, the gasket 58 includes an aperture 86 that defines a generally cuboid volume. The gasket 58 may be made from metal, silicone, polymer, or other appropriate materials.

When assembled, the heat exchanger 14 fits within a right-circular cylindrical volume with a diameter 59. The diameter 59 may be selected with the type of compressor 12 in mind. In various embodiments, the diameter 59 may be between 12 and 30 inches, e.g., approximately 18 inches. In other embodiments, though, the heat exchanger 14 may be configured to fit within volumes of a different shape or size.

Figure 4:
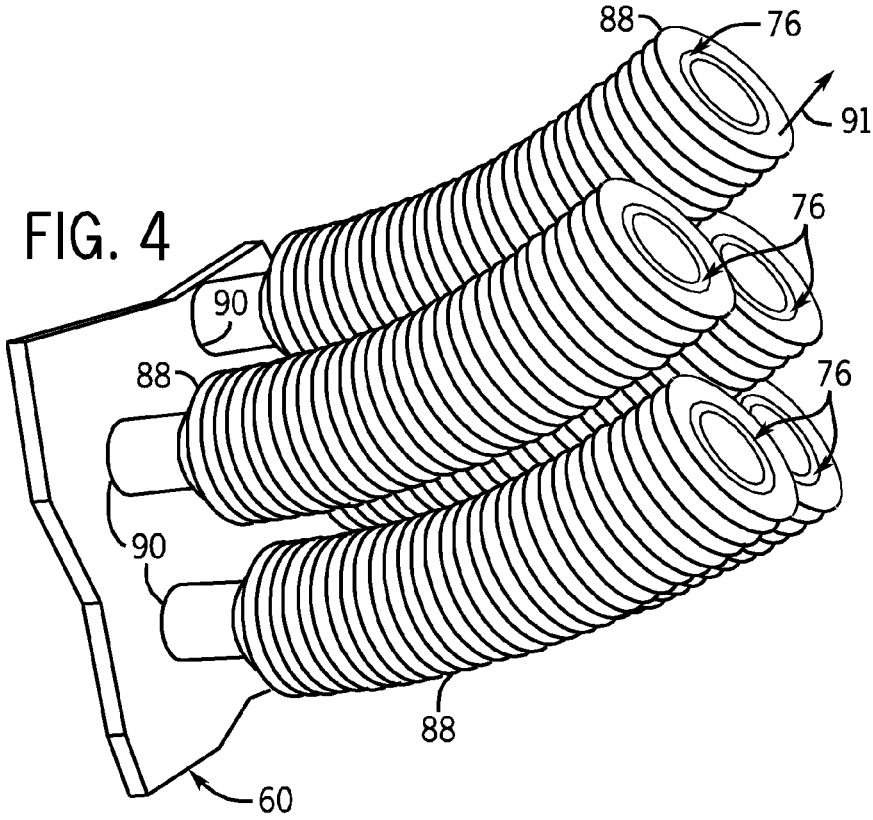
FIG. 4 is a close-up perspective view of tubes in the heat exchanger of FIG. 2.
Figure 5:
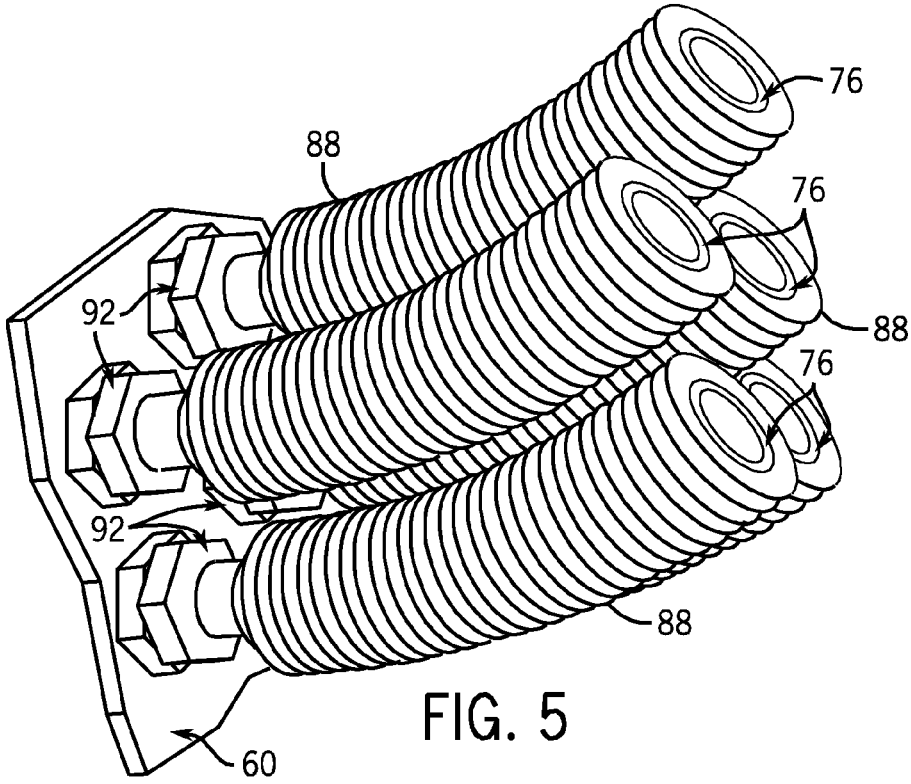
FIG. 5 is another close-up perspective view of the tubes in the heat exchanger of FIG. 2, illustrating another way to connect the tubes.

FIGS. 4 and 5 are close-up, cut-away, perspective views of the manifold cover 60 and the tubes 76. As illustrated, each of the tubes 76 is generally perpendicular to the surface of the manifold cover 60 near where the tubes 76 are joined to the manifold cover 60. In the embodiment of FIG. 4, the tubes 76 are joined to the manifold cover 60 by a joint 90 that may be welded or soldered. Alternatively, or additionally, in the embodiment of FIG. 5, the tubes are joined to the manifold cover 60 by a threaded coupling 92. The tubes 76 may be similarly joined to the manifold 46 and the headers 52 and 54. The tubes 76 also may be generally perpendicular to these components near where the tubes 76 are joined to the manifold 46 and the headers 52 and 54.

In this embodiment, each of the tubes 76 includes fins 88. The illustrated fins 88 are spaced at regular intervals in series along the length of the tubes 76 and each define a generally annular volume that is generally concentric with the tube 76. The sides of the fins 88 may be characterized by a normal vector 91 that is generally perpendicular to the central axis 34 and is generally tangent to the tubes 76. In other embodiments, the fins 88 may have a different shape or the fins 88 may be omitted, which is not to suggest that any other feature discussed herein may not also be omitted.

Figure 6:
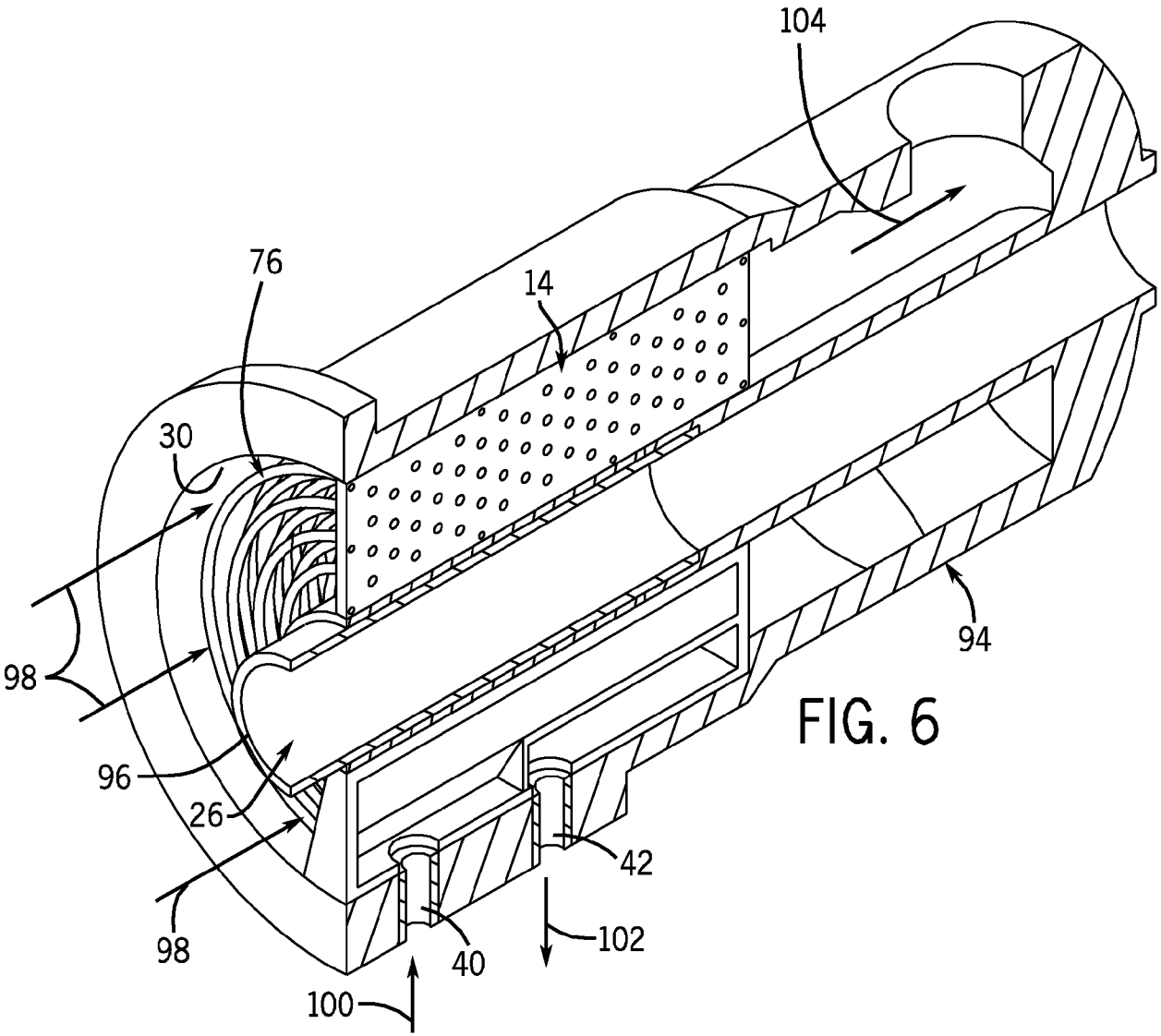
FIG. 6 is a cross-section of the heat exchanger of FIG. 2 installed in a component of the fluid-handling system of FIG. 1.

FIG. 6 is a cross-section of the heat exchanger 14 installed in a component of the compressor 12 referred to as a bonnet 94. In this embodiment, the bonnet 94 includes a main air pipe 96 that separates the upstream chamber 26 from the downstream chamber 30. The main air pipe 96 may be made of steel, stainless steel, bronze, brass, or other appropriate materials. As illustrated, the heat exchanger 14 is disposed in the downstream chamber 30. The tubes 76 and the manifold 46 of the heat exchanger 14 substantially circumscribe the main air pipe 96. The bonnet 94 may be made of cast iron, steel, or other appropriate materials.

In operation, the heat exchanger 14 removes thermal energy from fluid flowing through the bonnet 94. Hot, compressed fluid flows into the bonnet 94, as illustrated by arrow 98. In some embodiments, the fluid is air at between 100 and 500 degrees Fahrenheit. The fluid flows between the fins 88 of the tubes 76, and the fins 88 and the tubes 76 conduct heat away from the fluid. At the same time, coolant flows through the tubes 76 to evacuate the heat removed from the compressed fluid. The coolant may be water at between 50 and 150 degrees Fahrenheit, or some other temperature that is less than the temperature of the fluid. The coolant flows in the coolant inlet 40, as indicated by arrow 100, and the baffle 62 generally blocks the coolant from flowing directly to the coolant outlet 42. Instead, in this embodiment, the coolant flows through the manifold cover 60 and into the tube set 50. While flowing through the tube set 50, the coolant draws heat out of the tubes 76. When the coolant reaches the header 54, it flows through the holes 82, 80, and 78, as the fluid flows through the header 54, the gasket 56, and the header 52 and into the tube set 48. Next, the coolant flows through the tube set 48 and removes heat from its tubes 76 before flowing back into the downstream volume 68 of the manifold 46. Finally, the coolant flows out the coolant outlet 42, as indicated by the arrow 102, and, in some embodiments, back to the coolant source 20. In some embodiments, the coolant source 20 includes another heat exchanger to exchange heat between the used coolant and the atmosphere. In these embodiments, the coolant may be re-cooled and recycled back through the heat exchanger 14. After the compressed fluid flows past the heat exchanger 14, it may flow through the bonnet 94, as illustrated by arrow 104, and exit the compressor 12.

In some embodiments, the heat exchanger 14 may be easier to maintain than conventional designs. Because the coolant is separate from the bonnet 94, the bonnet 94 is not corroded by the coolant. As a result, in some embodiments, expensive operations to remove corrosion from the bonnet 94 may be avoided. Further, in some embodiments, the heat exchanger 14 may be relatively easy to clean. To clean the interior of the tube sets 48 and 50, the tube set 50 may be separated from the tube set 48 by disconnecting the headers 52 and 54 and the manifold cover 60. The interior of the tubes 76 may then be cleaned with a wire brush or chemicals. Alternatively, in some systems, the heat exchanger 14 may be disposable, and when corroded, the heat exchanger 14 may be replaced with a new heat exchanger 14.

Several variants of the heat exchanger 14 are envisaged. The heat exchanger 14 is referred to as a single-pass heat exchanger because coolant passes only one time around the heat exchanger 14 before exiting. That is, in the illustrated embodiment, the coolant does not flow through each tube set 48 or 50 multiple times. In other embodiments, though, the heat exchanger 14 may be a multi-pass heat exchanger, and the coolant may flow through each tube set 48 and 50 multiple times before exiting.

Figure 7:
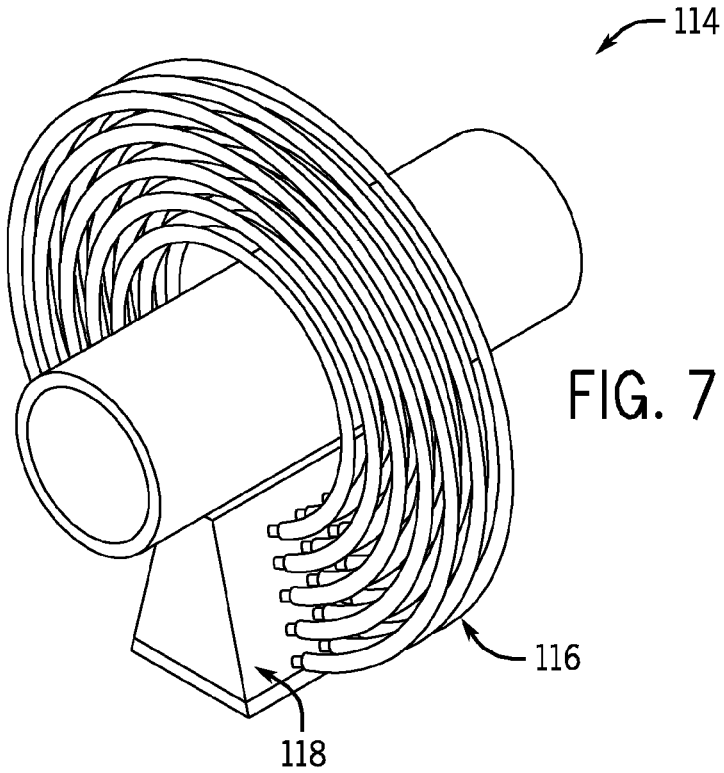
FIG. 7 is a perspective view of a second example of a heat exchanger.

FIG. 7 illustrates a second example of a heat exchanger 114. The illustrated heat exchanger 114 includes a tube set 116 and a manifold 118. In this embodiment, the tube set 116 is generally circular and is joined at each end directly to the manifold 118. The illustrated manifold 118 includes a baffle that directs coolant through the tube set 116. The tube set 116 may be joined to the manifold by welding, soldering, threaded couplings, or other appropriate joints.

Figure 8:
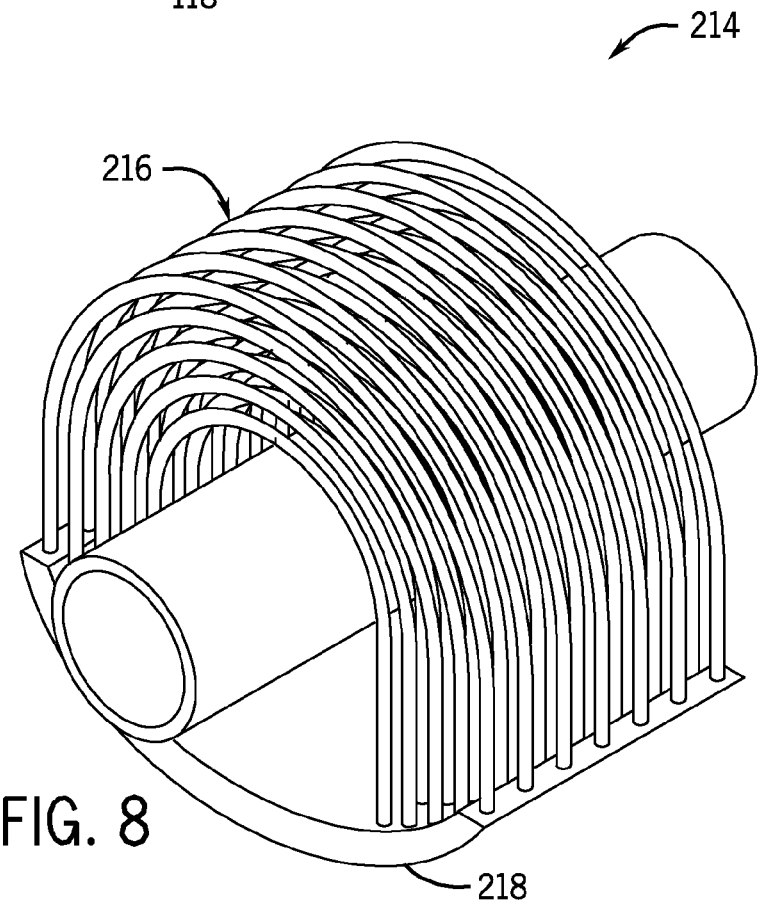
FIG. 8 is a perspective view of a third example of a heat exchanger.

FIG. 8 illustrates a third example of a heat exchanger 214. This embodiment includes a generally U-shaped tube set 216 and a generally oppositely oriented U-shaped manifold 218. As with the other embodiments, the illustrated manifold 218 includes a baffle to direct coolant through the tube set 216, and the tube set 216 may be joined to the manifold by welding, soldering, threaded couplings, or other appropriate joints.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A heat exchanger comprising:

a manifold having a coolant inlet and a coolant outlet; and a plurality of tubes configured to extend at least partially about a circumference of a main air pipe of a compressor bonnet, wherein an interior of each tube is fluidly connected to the manifold, and wherein the plurality of tubes is configured to receive coolant from the manifold, flow the coolant about the circumference of the main air pipe, and return the coolant to the manifold;

wherein the heat exchanger is configured to be disposed within a downstream chamber of the compressor bonnet directly adjacent to the main air pipe, such that fluid received through the main air pipe along a first axial direction is directed through the heat exchanger along a second axial direction, opposite the first axial direction.

2. The heat exchanger of claim 1, wherein the manifold comprises:

a baffle;

an upstream volume on one side of the baffle and in direct fluid communication with the coolant inlet; and a downstream volume on another side of the baffle and in direct fluid communication with the coolant outlet.

3. The heat exchanger of claim 1, wherein the manifold generally has the shape of a right prism with a generally trapezoid base.

4. The heat exchanger of claim 1, wherein each tube among the plurality of tubes has a longitudinal axis that is generally curved along a substantial portion of its length.

5. The heat exchanger of claim 1, wherein each tube among the plurality of tubes is generally concentric about the main air pipe.

6. The heat exchanger of claim 1, wherein the plurality of tubes comprises:

a first tube set generally curved along a first C-shaped path and coupled at one end to the manifold; and a second tube set generally curved along a second C-shaped path and coupled at one end to the manifold, wherein a header couples another end of the first tube set to another end of the second tube set.

7. A system comprising:

a compressor comprising:

an impeller;

a main air pipe that flows fluid to the impeller along a first axial direction;

a downstream chamber disposed about the main air pipe, wherein the downstream chamber receives the fluid from the impeller along a second axial direction, opposite the first axial direction;

a heat exchanger disposed within the downstream chamber, and comprising:

a tube set comprising a plurality of tubes, wherein each tube extends at least partially about a circumference of the main air pipe, and the tube set flows coolant about the circumference of the main air pipe; and a manifold fluidly coupled to the tube set, and coupled to a coolant inlet and a coolant outlet.

8. The system of claim 7, comprising a header coupled to the tube set.

9. The system of claim 8, wherein the header comprises a plurality of holes generally arranged in a hexagonal lattice.

10. The system of claim 7, comprising:

a fluid source fluidly coupled to an inlet of the compressor, wherein the inlet is fluidly coupled to the main air pipe;

a motor mechanically coupled via a shaft to the impeller; and a fluid destination fluidly coupled to a downstream side of the heat exchanger.

11. The system of claim 10, wherein the fluid source, the fluid destination, or both are another compressor.

12. The system of claim 7, wherein the tube set and the manifold substantially circumscribe the main air pipe.

13. The system of claim 7, wherein the tube set generally has a U shape.

* * * * *